US009376861B2

(12) United States Patent
Lin

(10) Patent No.: US 9,376,861 B2
(45) Date of Patent: Jun. 28, 2016

(54) WINDING DEVICE AND CORDLESS ROLLER BLIND INCORPORATING THE SAME

(71) Applicant: Ya-Yin Lin, Chiayi (TW)

(72) Inventor: Ya-Yin Lin, Chiayi (TW)

( * ) Notice: Subject to any disclaimer, the term of this patent is extended or adjusted under 35 U.S.C. 154(b) by 30 days.

(21) Appl. No.: 14/265,955

(22) Filed: Apr. 30, 2014

(65) Prior Publication Data

US 2015/0315843 A1 Nov. 5, 2015

(30) Foreign Application Priority Data

Feb. 18, 2014 (TW) ..... 103105265 A

(51) Int. Cl.
*E06B 9/42* (2006.01)
*E06B 9/78* (2006.01)

(52) U.S. Cl.
CPC .... *E06B 9/42* (2013.01); *E06B 9/78* (2013.01)

(58) Field of Classification Search
CPC ..... E06B 9/42; E06B 9/78; E06B 9/56; E06B 9/60
USPC ..... 160/313, 314
See application file for complete search history.

(56) References Cited

U.S. PATENT DOCUMENTS

| | | | | |
|---|---|---|---|---|
| 324,135 A | | 8/1885 | Malmstrom | |
| 1,865,466 A | * | 7/1932 | Gossling | E06B 9/90 160/303 |
| 4,729,418 A | * | 3/1988 | Rude | E06B 9/60 160/323.1 |
| 8,251,120 B2 | * | 8/2012 | Chen | E06B 9/42 160/314 |
| 2012/0061037 A1 | | 3/2012 | Chen | |
| 2013/0190119 A1 | * | 7/2013 | Barnes | E06B 9/42 474/144 |
| 2014/0157547 A1 | * | 6/2014 | Chen | E06B 9/42 16/400 |
| 2015/0211295 A1 | * | 7/2015 | Chen | E06B 9/56 160/176.1 R |

FOREIGN PATENT DOCUMENTS

| | | | |
|---|---|---|---|
| JP | 2000-73677 | A | 3/2000 |
| JP | 2004-244877 | A | 9/2004 |
| WO | WO 2008/025494 | A | 3/2008 |

OTHER PUBLICATIONS

Extended search report from European Patent Office for corresponding European application 14169041.2 dated Jul. 7, 2015.

* cited by examiner

*Primary Examiner* — Blair M Johnson
(74) *Attorney, Agent, or Firm* — Frommer Lawrence & Haug LLP

(57) ABSTRACT

A winding device for a cordless roller blind includes a mounting seat, a winding unit and a connecting mechanism. The mounting seat is mountable on a supporting structure. The connecting mechanism is for connecting removably the winding unit to the mounting seat in such a manner that the winding unit is upright when connected to the mounting seat. The connecting mechanism includes a first connecting set that is disposed on one of a casing of the winding unit and the mounting seat, and at least two second connecting sets that are disposed on the other of the casing and the mounting seat. The first connecting set is removably engageable with one of the second connecting sets so as to connect removably the winding unit to the mounting seat.

6 Claims, 14 Drawing Sheets

WINDING DEVICE AND CORDLESS ROLLER BLIND INCORPORATING THE SAME

BACKGROUND OF THE INVENTION

1. Field of the Invention

The invention relates to a blind, more particularly to a cordless roller blind and a winding device thereof.

2. Description of the Related Art

As shown in FIGS. 1 and 2, U.S. Patent Application Publication No. US2012/0061037A1 discloses a conventional cordless roller blind 1, which is adapted to be mounted on a wall 10, and which includes two seats 11, 12 spacedly arranged in a horizontal direction, a winding unit 13 mounted on an inner side of the seat 12, and a blind unit 14 mounted between the seats 11, 12. The blind unit 14 includes a shaft 141, a link head 142 connected co-movably to the shaft 141 and disposed proximate to the winding unit 13, and a blind 143 rolled releasably on the shaft 141. The seat 12 is L-shaped with one segment 121 to be secured to the wall 10, and another segment 122 protruding transversely from the wall 10 and having two posts 123, 124 that extend transversely toward the winding unit 13.

The winding unit 13 includes a cover 131 disposed at an inner side of the segment 122, a winding wheel 132 mounted rotatably on the post 124 and being connected co-rotatably with the link head 142, and a torsion spring 133 connected at two ends respectively to the post 123 and the winding wheel 132. By virtue of the cooperation between the torsion of the torsion spring 133 and the weight of the blind unit 14, the blind 143 is disposed in a balanced state cordlessly. When an external force is exerted to break the balance, such as pulling up or down the blind 143, the unrolled length of the blind 143 may be adjusted.

When the wall 10 on which the conventional cordless roller blind 1 is mounted is a vertical wall, since the direction of arrangement of the winding wheel 132 and the post 123, to which the torsion spring 133 is connected, is transverse to the vertical wall 10, the conventional cordless roller blind 1 will protrude from the vertical wall 10 by a rather large distance. In other words, the cover 131 is designed to have an elongate shape in order to accommodate for the arrangement of the winding wheel 132 and the torsion spring 133; therefore, the long side of the cover 131 will be perpendicular to the vertical wall 10 upon installation, affecting the overall aesthetic appeal. Further, this downside becomes more prominent if a greater torsion spring 133 needs to be employed to balance the weight of a heavier blind 143, which would also impose application restrictions on the conventional cordless roller blind 1.

SUMMARY OF THE INVENTION

Therefore, an object of this invention is to provide a winding device and a cordless roller blind incorporating the same that can eliminate the drawback of the prior art.

Accordingly, there is provided a winding device for a cordless roller blind. The winding device is adapted to be mounted to a supporting structure opposite to a securing seat to cooperate with the securing seat for securing therebetween a blind unit, which includes a pole and a blind wound around the pole. The winding device includes a mounting seat, a winding unit and a connecting mechanism. The mounting seat is adapted to be mounted on the supporting structure. The winding unit includes a casing and a winding set that is mounted to the casing and that is adapted for rolling the pole to bring the blind to fold upwardly and unfold downwardly relative to the securing seat and the mounting seat. The connecting mechanism is for connecting removably the winding unit to the mounting seat in such a manner that the winding unit is upright when connected to the mounting seat. The connecting mechanism includes a first connecting set that is disposed on one of the casing and the mounting seat, and two second connecting sets that are disposed on the other of the casing and the mounting seat. The first connecting set is removably engageable with one of the second connecting sets so as to connect removably the winding unit to the mounting seat.

A cordless roller blind incorporating the above-mentioned winding device is also provided.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
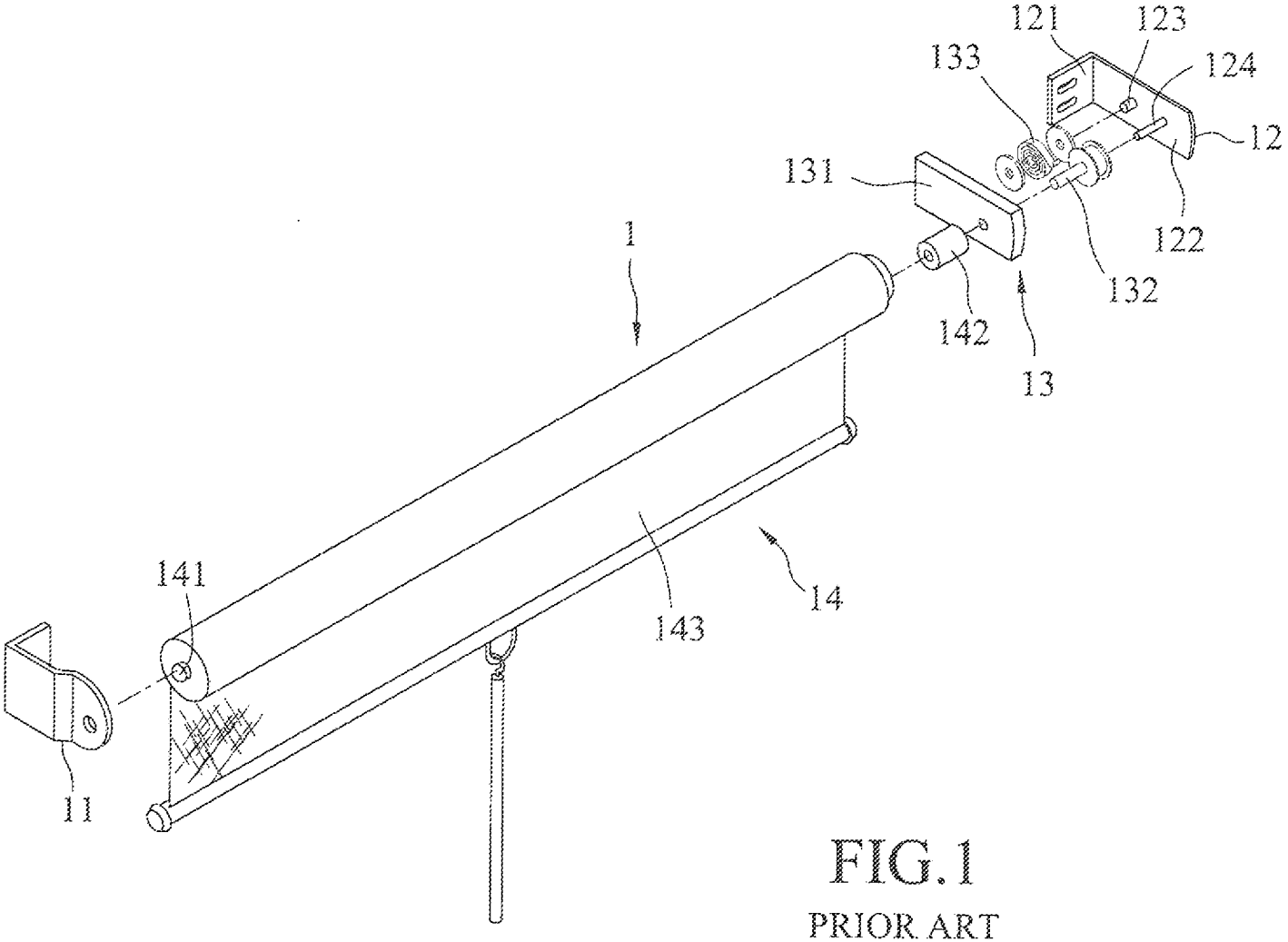
FIG. 1 PRIOR ART
FIG. 1 is an exploded perspective view of a conventional cordless roller blind.

Before the present invention is described in greater detail with reference to the accompanying preferred embodiments, it should be noted herein that like elements are denoted by the same reference numerals throughout the disclosure.

Figure 3:
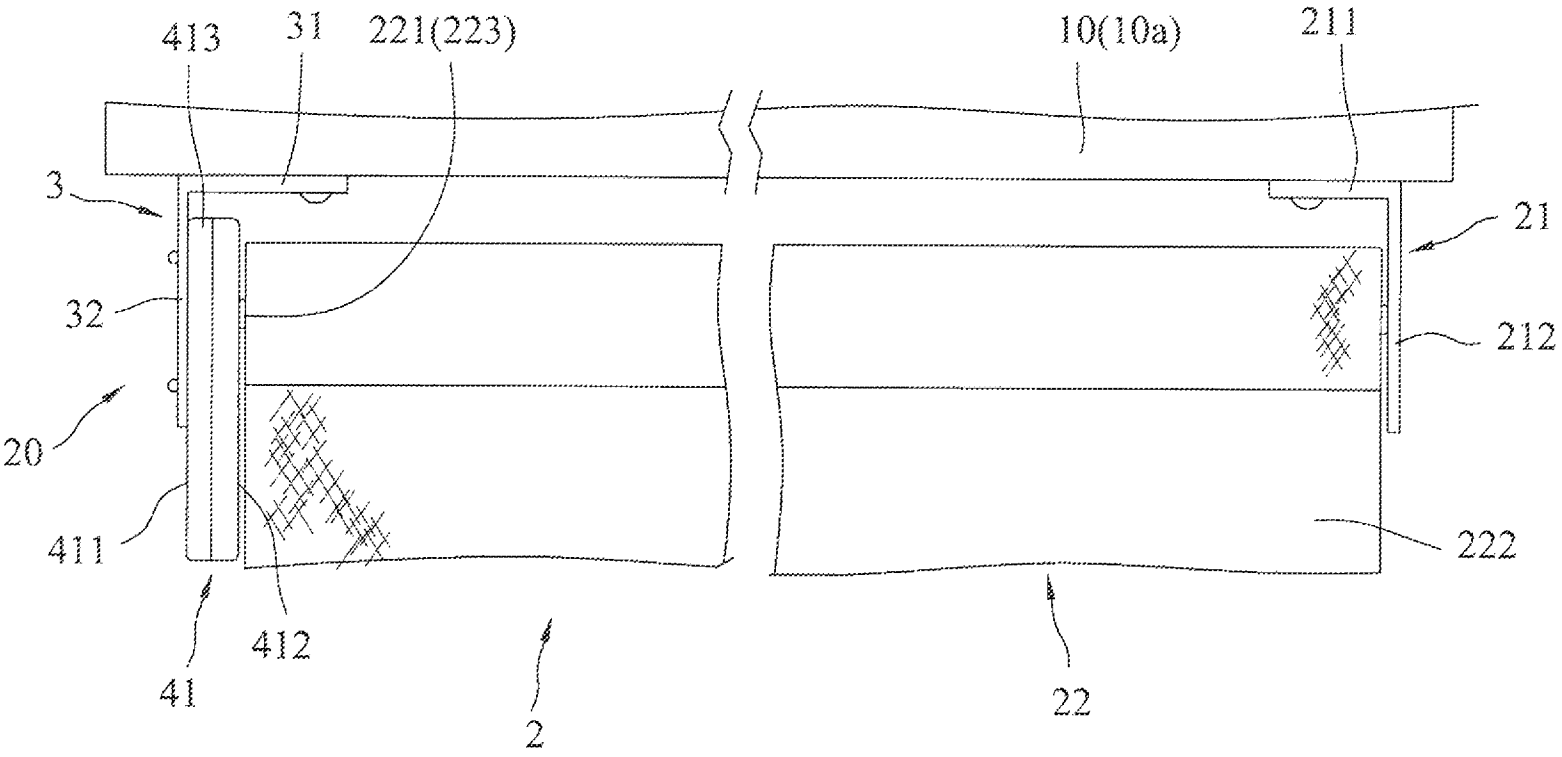
FIG. 3 is a fragmentary schematic front view of the first preferred embodiment of a cordless roller blind according to this invention.
Figure 4:
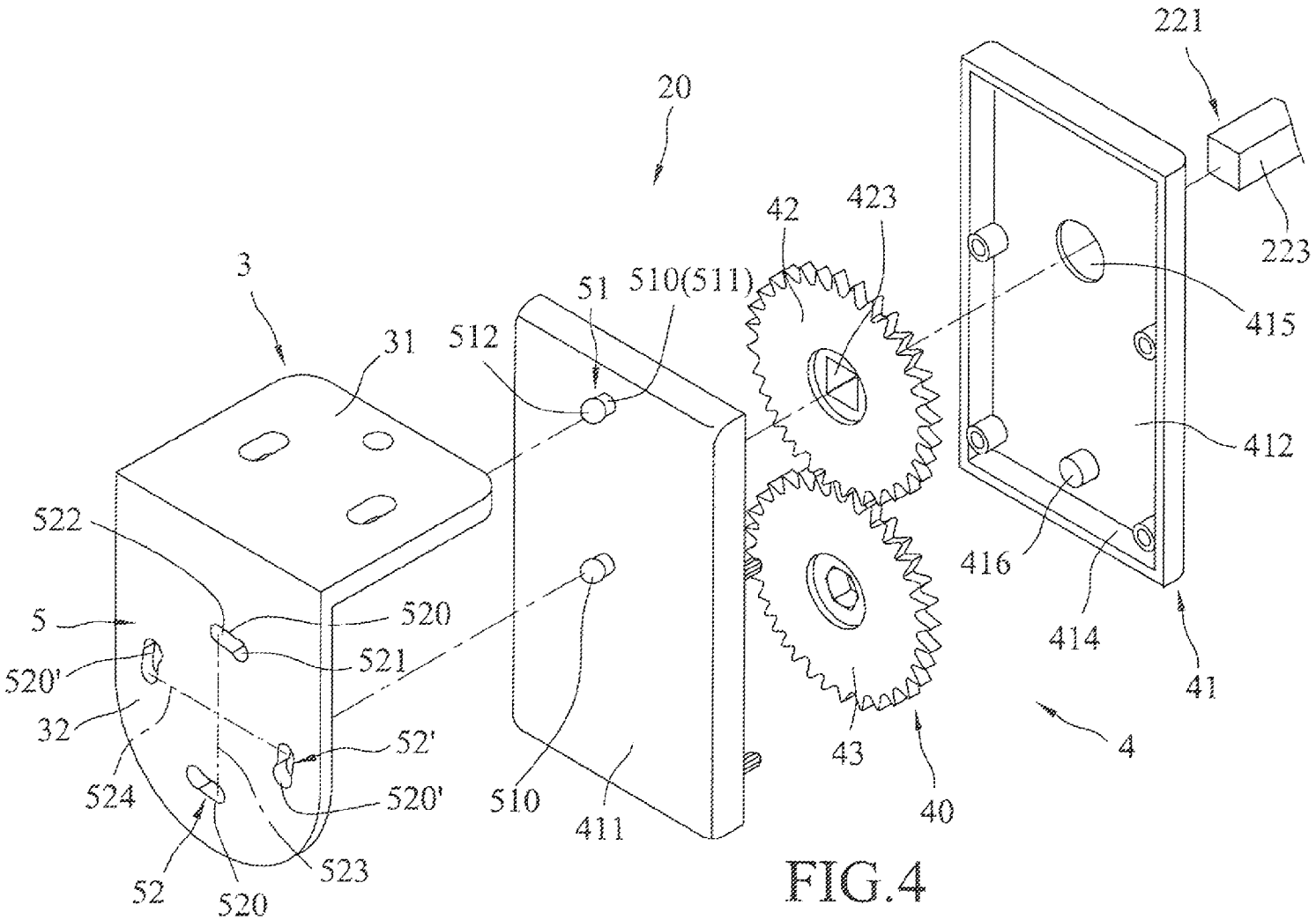
FIG. 4 is a fragmentary exploded perspective view of the first preferred embodiment, illustrating a winding device.
Figure 5:
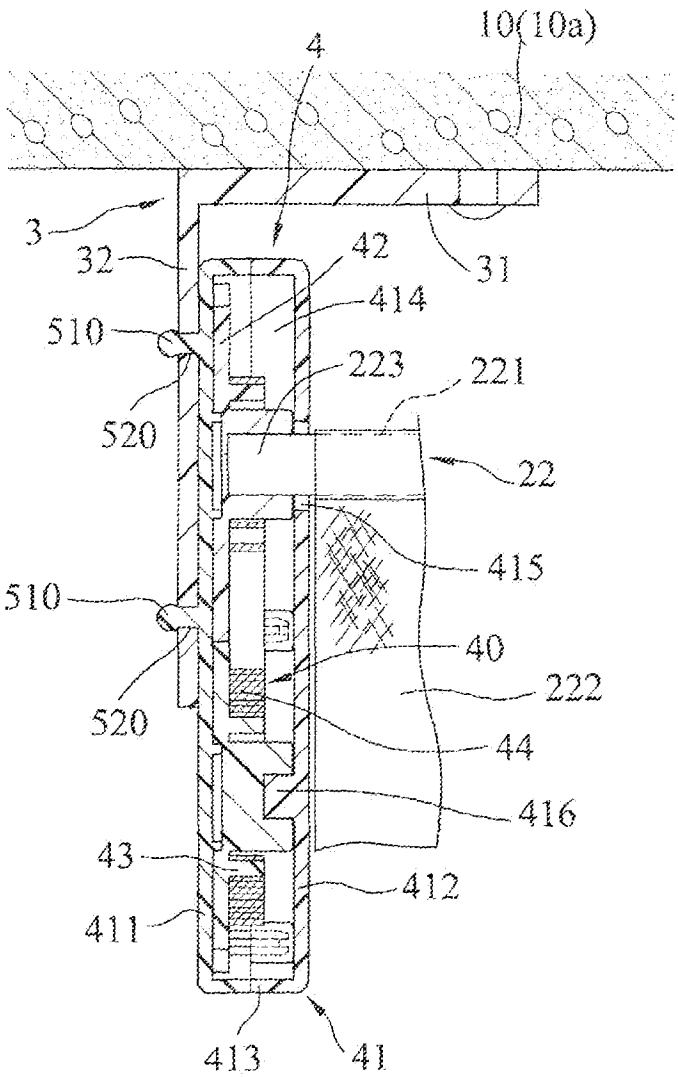
FIG. 5 is a fragmentary sectional view of the first preferred embodiment.
Figure 8:
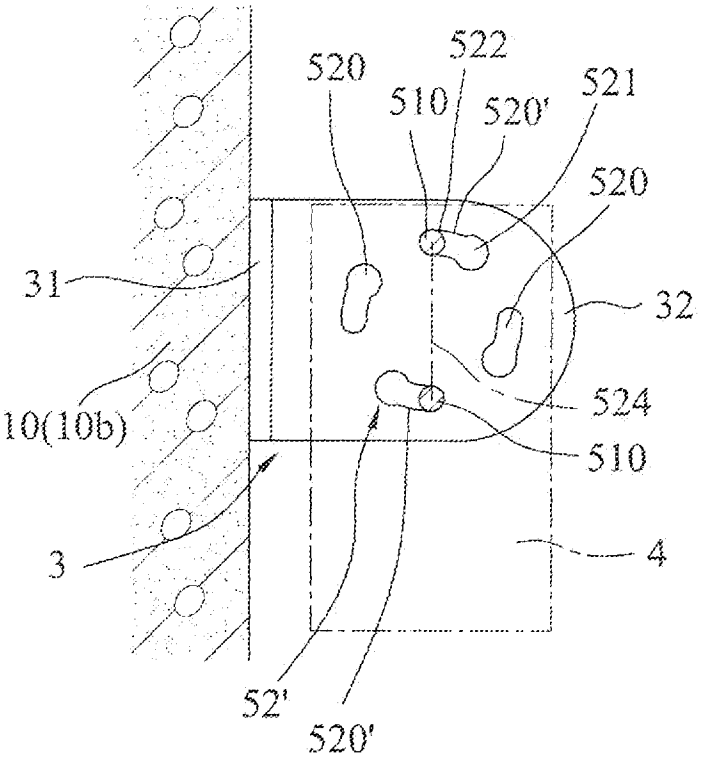
FIG. 8 is similar to FIG. 7, but illustrating when the first preferred embodiment is mounted on a vertical supporting structure.

Referring to FIGS. 3 to 5, the first preferred embodiment of a cordless roller blind 2 according to the present invention is adapted to be mounted to a supporting structure 10, where the supporting structure 10 may be one of a horizontal supporting structure 10*a* (e.g., ceiling, horizontal beam, etc.) and a vertical supporting structure 10*b* (see FIG. 8). The supporting structure 10 is shown to be a horizontal supporting structure 10*a* in FIG. 3. The cordless roller blind 2 includes a securing seat 21 and a winding device 20 adapted to be oppositely mounted to the supporting structure 10 (to and beneath the horizontal supporting structure 10*a*), and a blind unit 22 mounted between the securing seat 21 and the winding device 20. The securing seat 21 includes a securing wall segment 211 adapted to be secured to the supporting structure 10 via a fastener, and a mounting wall segment 212 extending transversely from the securing wall segment 211 and protruding from the supporting structure 10. The blind unit 22 includes an elongate pole 221 and a blind 222 woundable on the pole 221. The pole 221 includes a link head 223 disposed proximate to the winding device 20. Further details of the structures of the securing seat 21 and the blind unit 22 are omitted herein for the sake of brevity.

The winding device 20 of this embodiment includes a mounting seat 3 adapted to be mounted to the supporting structure 10 opposite to the securing seat 21, a winding unit 4, and a connecting mechanism 5 for connecting removably the winding unit 4 to the mounting seat 3 in such a manner that the winding unit 4 is upright when connected to the mounting seat 3.

The mounting seat 3 has a first wall segment 31 adapted to be secured to the supporting structure 10, and a second wall segment 32 connected at a right angle to the first wall segment 31 and projecting from the supporting structure 10. The second wall segment 32 is opposite to and spaced apart from the mounting wall segment 212 of the securing seat 21 after the securing seat 21 and the mounting seat 3 are mounted to the supporting structure 10.

Figure 6:
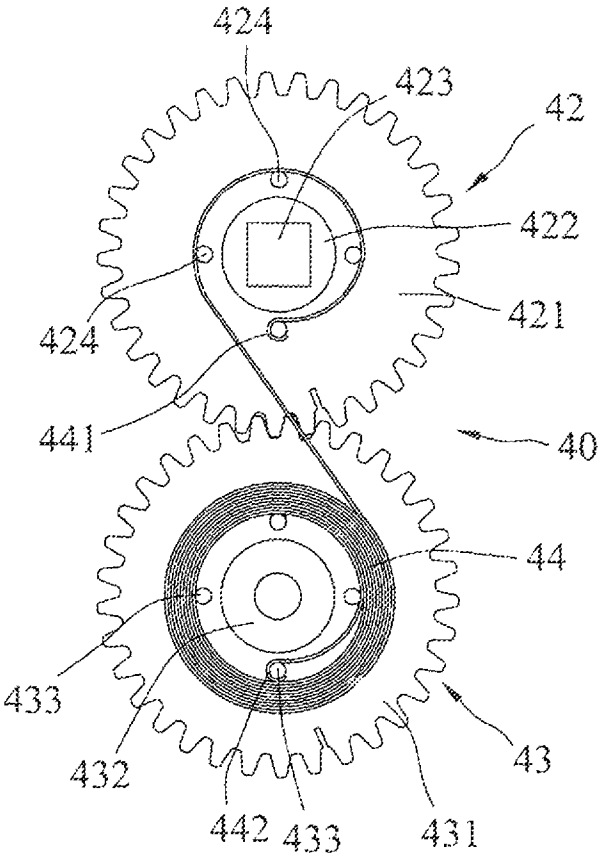
FIG. 6 is a schematic view of a winding unit of the winding device of the first preferred embodiment, where a casing is omitted.

Referring to FIGS. 4 to 6, the winding unit 4 includes an elongate casing 41 and a winding set 40. The casing 41 is divided into two casing parts, and has a first, casing wall 411 disposed proximate to the second wall segment 32 of the mounting seat 3, a second casing wall 412 opposite to the first casing wall 411, and a connecting casing wall 413 interconnecting the first and second casing walls 411, 412 and cooperating with the first and second casing walls 411, 412 to define a casing space 414. The second casing wall 412 is formed with a through hole 415 adapted for extension of the link head 223 of the pole 221 of the blind unit 22 therethrough, and is provided with a post 416 that protrudes into the casing space 414.

The winding set 40 is mounted in the casing space 414 of the casing 41, is adapted for rolling the pole 221 to bring the blind 222 to fold upwardly and unfold downwardly relative to the securing seat 21 and the mounting seat 3, and includes a first gear wheel 42 that is adapted to be connected, co-rotatably with the pole 221, a second gear wheel 43 that meshes with the first gear wheel 42, and an elastic strip 44. The first gear wheel 42 has a first wheel portion 421, a first protruding shaft portion 422 protruding transversely from a center of the first wheel portion 421 and formed therethrough with a link hole 423, and a plurality of first studs 424 surrounding the link hole 423. The second gear wheel 43 has a second wheel portion 431, a second protruding shaft portion 432 protruding transversely from a center of the second wheel portion 431, and a plurality of second studs 433 surrounding the second protruding shaft portion 432. The elastic strip 44 has opposite first and second securing ends 441, 442, where the first securing end 441 is connected to one of the first studs 424 and the second securing end 442 is connected to one of the second studs 433, and the elastic strip 44 is wound resiliently around the first protruding shaft portion 422 of the first gear wheel 42 and the second protruding shaft portion 432 of the second gear wheel 43.

The connecting mechanism 5 includes a first connecting set 51 disposed on one of the first casing wall 411 of the casing 41 and the second wall segment 32 of the mounting seat 3, and two second connecting sets 52, 52' disposed on the other of the first casing wall 411 and the second wall segment 32. The first connecting set 51 is removably engageable with one of the second connecting sets 52, 52' so as to connect removably the winding unit 4 to the mounting seat 3. In this embodiment, the first connecting set 51 includes two spaced-apart first connecting elements 510 and is provided on the first casing wall 411, and each of the second connecting sets 52, 52' includes two spaced-apart second connecting elements 520, 520' and is provided on the second wall segment 32. The first connecting elements 510 are respectively engageable with the second connecting elements 520, 520' of one of the second connecting sets 52, 52'.

As illustrated in FIG. 4, each of the first connecting elements 510 is a male connecting element in the form of a protrusion having a head portion 512 and a neck portion 511 that is connected to the head portion 512, that is smaller in dimension than the head portion 512, and that is integrally formed on the first casing wall 411. Each of the second connecting elements 520, 520' is a female connecting element in the form of a hole that is formed in the second wall segment 32 and that has a large dimension portion 521 and a small dimension portion 522 connected to the large dimension portion 521 and smaller in dimension than the large dimension portion 521. A line 523 that connects the holes 520 of the second connecting set 52 is substantially perpendicular to a line 524 that connects the holes 520' of the second connecting set 52'. The protrusion 510 is extendible into the large dimension portion 521 of the hole 520, 520' and is restricted from moving out of the hole 520, 520' by the head portion 512 when the protrusion 510 is moved from having the neck portion 511 extending through the large dimension portion 521 to having the neck portion 511 extending through the small dimension portion 522. The second connecting elements 520, 520' of this embodiment are arranged such that the large diameter portion 521 of each element 520, 520' is disposed in a clockwise direction relative to the smaller diameter portion 522 of the same element 520, 520', but the invention is not limited in this aspect.

Figure 7:
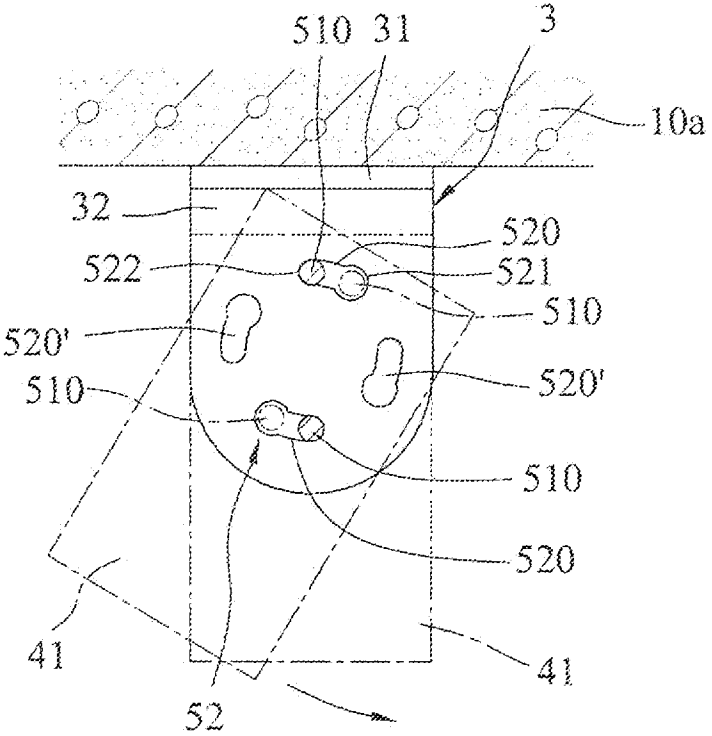
FIG. 7 is a schematic diagram for illustrating a mounting seat and the casing of the winding device when the first preferred embodiment is mounted on a horizontal supporting structure.

Referring to FIGS. 3, 4 and 7, when the cordless roller blind 2 of this embodiment is mounted to the horizontal supporting structure 10*a*, the securing wall segment 211 of the securing seat 21 and the first wall segment 31 of the mounting seat 3 are mounted to and disposed below the horizontal supporting structure 10*a*. The mounting wall segment 212 of the securing seat 21 and the second wall segment 32 of the mounting seat 3 extend vertically and downwardly, and are spaced apart from each other along a horizontal direction. Meanwhile, the link head 223 of the pole 221 of the blind unit 22 is extended into the through hole 415 of the casing 41 of the winding unit 4 to engage the link hole 423 of the first gear wheel 42 of the winding unit 4 such that the pole 221 is co-movable with the first gear wheel 42. Thereafter, the assembled blind unit 22 and winding unit 4 is hung between the mounting wall segment 212 of the securing seat 21 and the second wall segment 32 of the mounting seat 3. For hanging such assembly, the head portions 512 of the first connecting elements 51 are extended respectively through the large dimension portions 521 of the second connecting elements 520 of the second connecting set 52, and then the assembly is rotated counterclockwise till the neck portions 511 of the first connecting elements 51 respectively engage the small dimension portions 522 of the second connecting elements 520 to secure the cordless roller blind 2 between the securing seat 21 and the mounting seat 3 and complete installation of the cordless roller blind 2 on the horizontal supporting structure 10*a*.

After the installation, the winding unit 4 is upright with the long side of the casing 41 being perpendicular to the horizontal supporting structure 10*a*. That is, the first and second gear wheels 42, 43 of the winding set 40 are vertically arranged to mesh with each other. As such, if the first preferred embodiment of the cordless roller blind 2 according to the present invention is mounted beneath a supporting structure 10 such as a ceiling, the winding unit 4 remains upright and the long side thereof extends transversely to the ground.

Figure 9:
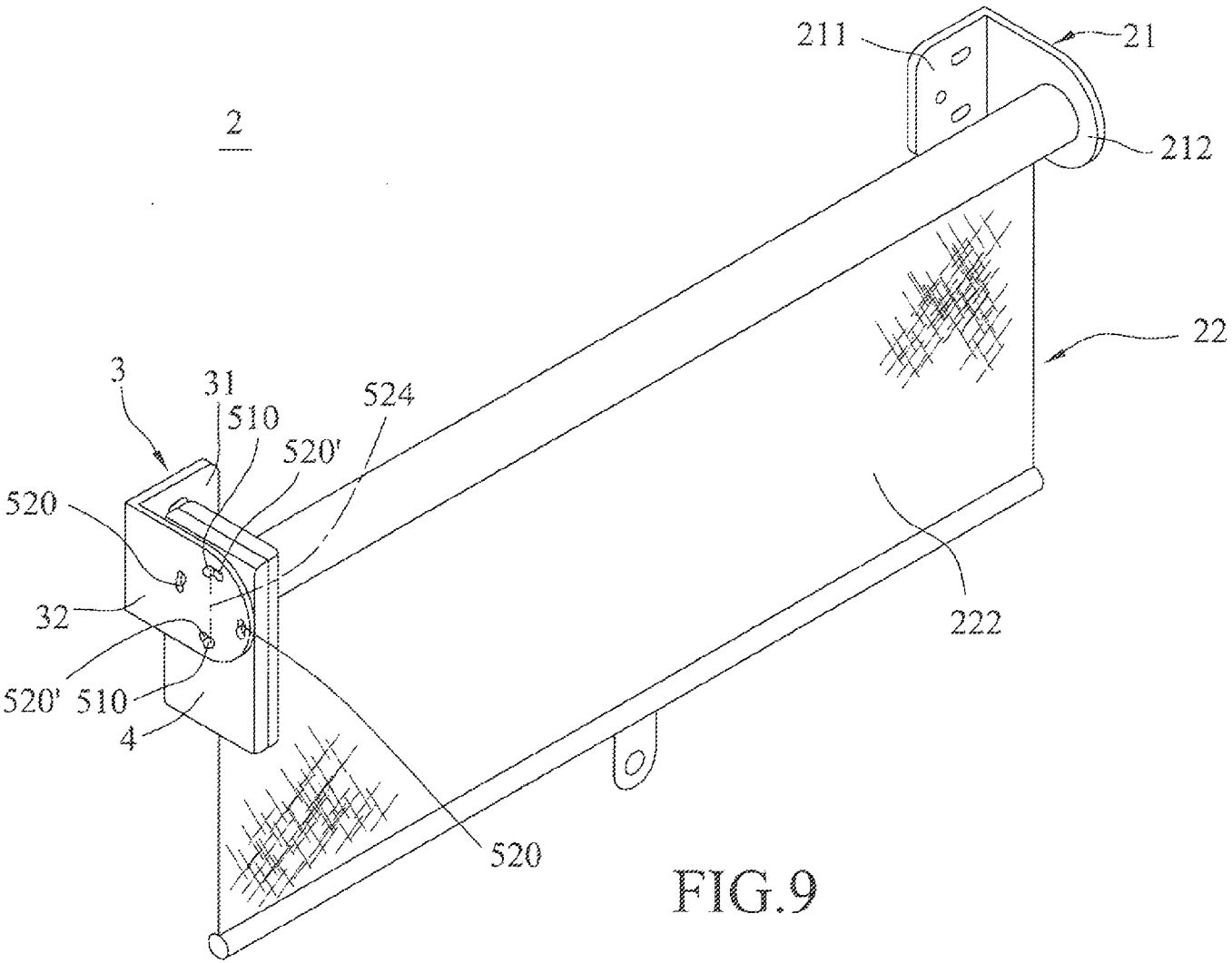
FIG. 9 is an assembled perspective view of the first preferred embodiment, illustrating the casing disposed in an upright position.

Referring to FIGS. 4, 8 and 9, when the cordless roller blind 2 of the first preferred embodiment is mounted to the vertical supporting structure 10*b*, the securing wall segment 211 of the securing seat 21 and the first wall segment 31 of the mounting seat 3 are mounted to and beside the vertical supporting structure 10*b* such that the mounting wall segment 212 of the securing seat 21 and the second wall segment 32 of the mounting seat 3 extend horizontally and sideways from the vertical supporting structure 10*b*. In this case, the first connecting elements 510 are connected respectively to the second connecting elements 520' of the second connecting set 52'. Since the line 524 connecting the second connecting elements 520' is vertical to the ground (i.e., parallel to the vertical supporting structure 10*b*), the winding unit 4 is still disposed in an upright manner.

Figure 2:
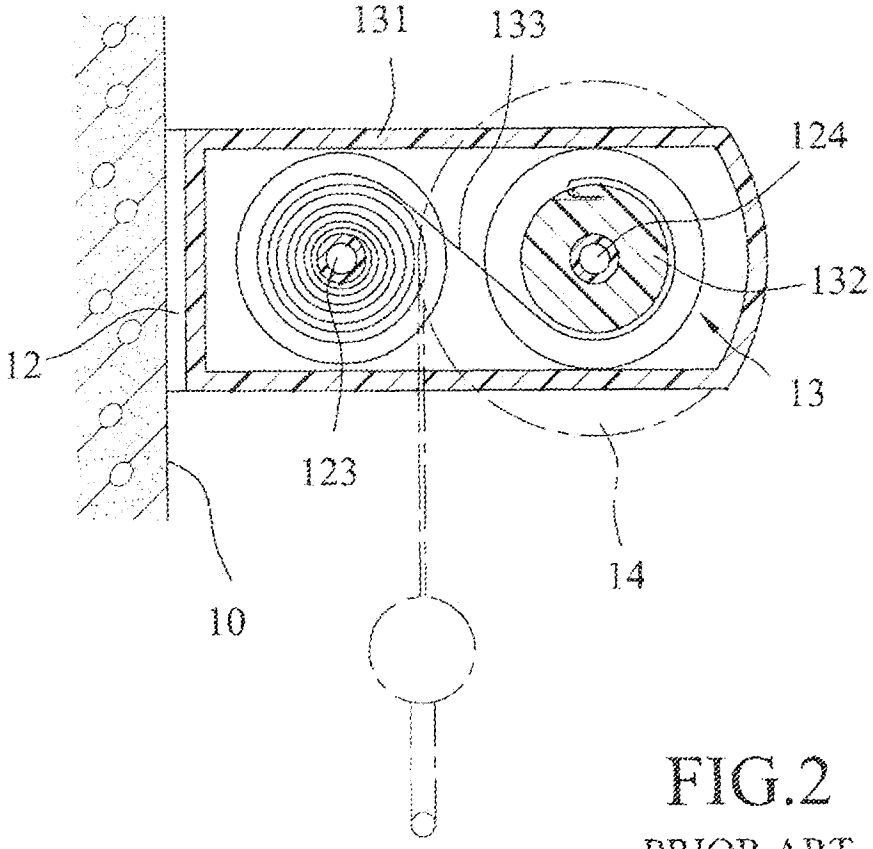
FIG.2 PRIOR ART
FIG. 2 is a sectional view, illustrating a winding unit of the conventional cordless roller blind.

From the foregoing description, regardless of whether the cordless roller blind 2 of this embodiment is mounted to a horizontal supporting structure 10*a* or a vertical supporting structure 10*b*, the long side of the winding unit 4 is always upright, i.e., perpendicular to the ground. With such structural design, when the cordless roller blind 2 is mounted to the vertical supporting structure 10*b*, the winding unit 4 is prevented from protruding too much sideways as with the conventional cordless roller blind 1 (depicted in FIGS. 1 and 2), so that aesthetic appeal of the installed cordless roller blind 2 is enhanced. Moreover, this advantage is more evident when the blind unit 22 becomes bulkier and heavier and requires a bigger/longer winding unit 4.

Figure 10:
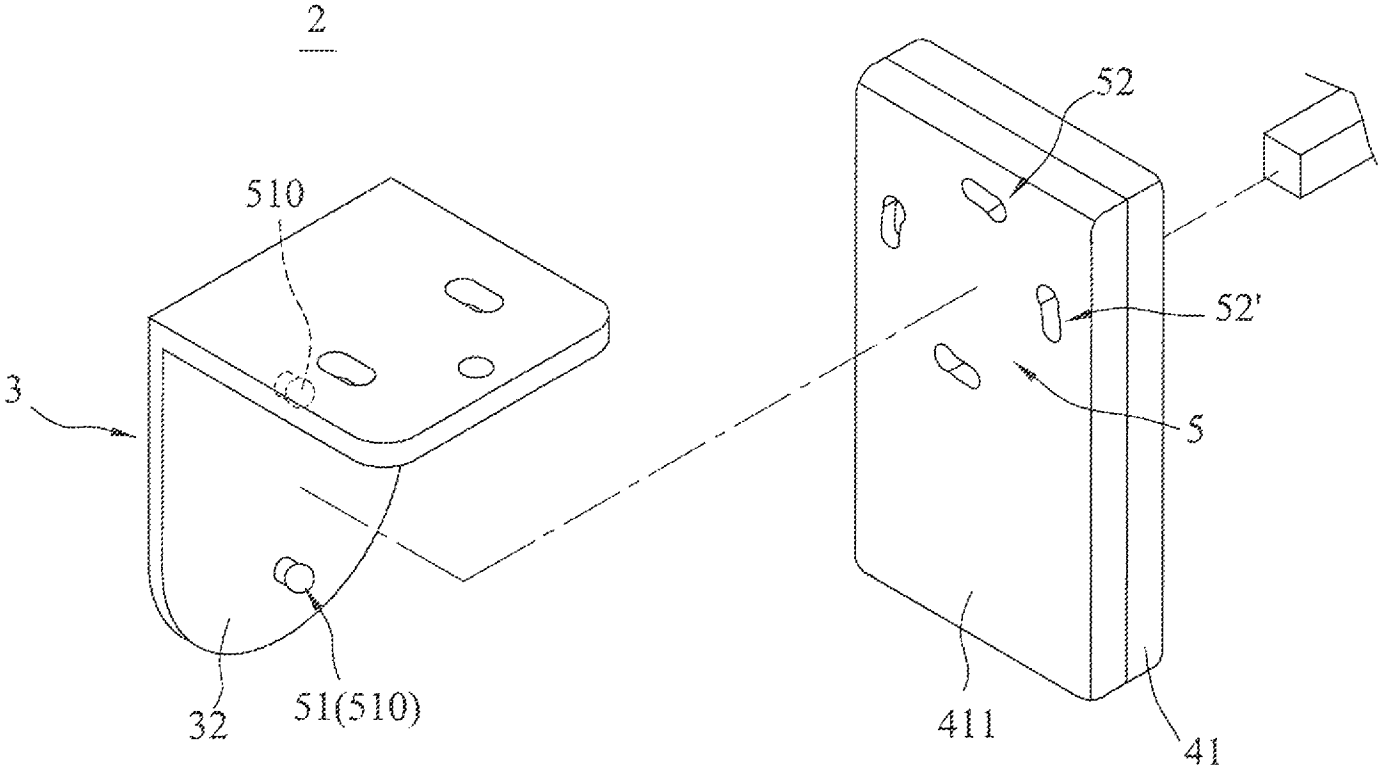
FIG. 10 is a fragmentary, partly-exploded view of the second preferred embodiment of a cordless roller blind according to the present invention.

Referring to FIG. 10, the second preferred embodiment of a cordless roller blind 2 according to this invention is similar to the first preferred embodiment except that placements of the first connecting set 51 and the second connecting sets 52, 52' are interchanged. That is, the first connecting set 51 is provided on the second wall segment 32 of the mounting seat 3, whereas the second connecting sets 52, 52' are provided on the first casing wall 411 of the casing 41. It is understandable that the same effect is achieved by the second preferred embodiment.

Figure 11:
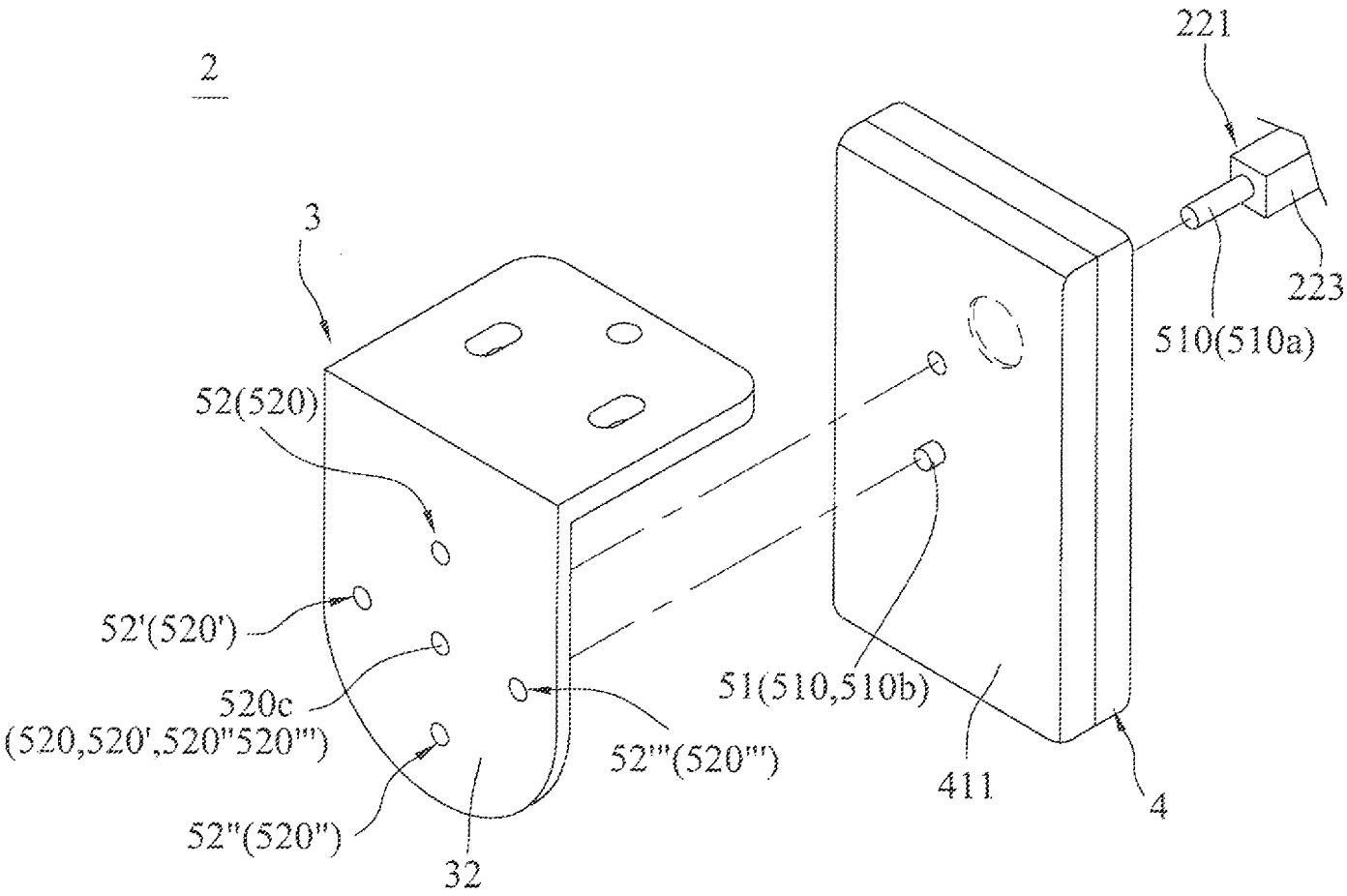
FIG. 11 is a fragmentary, partly-exploded view of the third preferred embodiment of a cordless roller blind according to the present invention.
Figure 12:
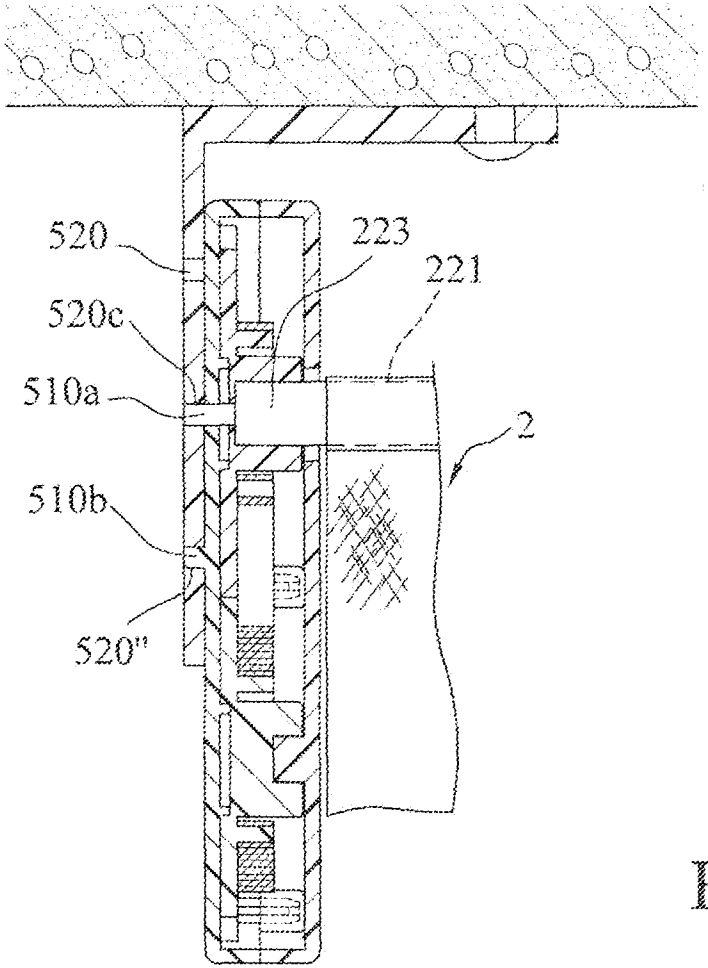
FIG. 12 is a fragmentary sectional view of the third preferred embodiments.

Referring to FIGS. 11 and 12, the third preferred embodiment of a cordless roller blind 2 according to this invention is similar to the first preferred embodiment except that of the two first connecting elements 510 of the first connecting set 51, one 510*a* is formed coaxially and integrally on the link head 223 of the pole 221 and extends through and protrudes from the first casing wall 411 and the other 501*b* is formed integrally on the first casing wall 411; that there are four second connecting sets 52, 52', 52", 52'", each having two second connecting elements 520, 520', 520'", 520'" with a common second connecting element 520*c* among the four second connecting sets 52, 52', 52", 52'" where the common second connecting element 520*c* is surrounded by and equidistant from the other second connecting elements 520, 520', 520", 520'" (i.e., there are only five second connecting elements in total); and that each of the second connecting elements 520, 520', 520", 520'" is a circular through hole formed in the second wall segment 32 while each of the first connecting elements 510 is a protrusion with a uniform cross-section. To engage the winding unit 4 and the mounting seat 3, the first connecting elements 510 respectively engage the second connecting elements 520, 520', 520", 520'" of one of the four second connecting sets 52, 52', 52", 52'", i.e., the first connecting element 510*a* formed on the link head 223 engages the common second connecting element 520*c* and the first connecting element 510*b* formed on the first casing wall 411 engages a selected one of the other second connecting elements 520, 520', 520", 520'". The effect achieved by the third preferred embodiment is the same as discussed above.

Figure 13:
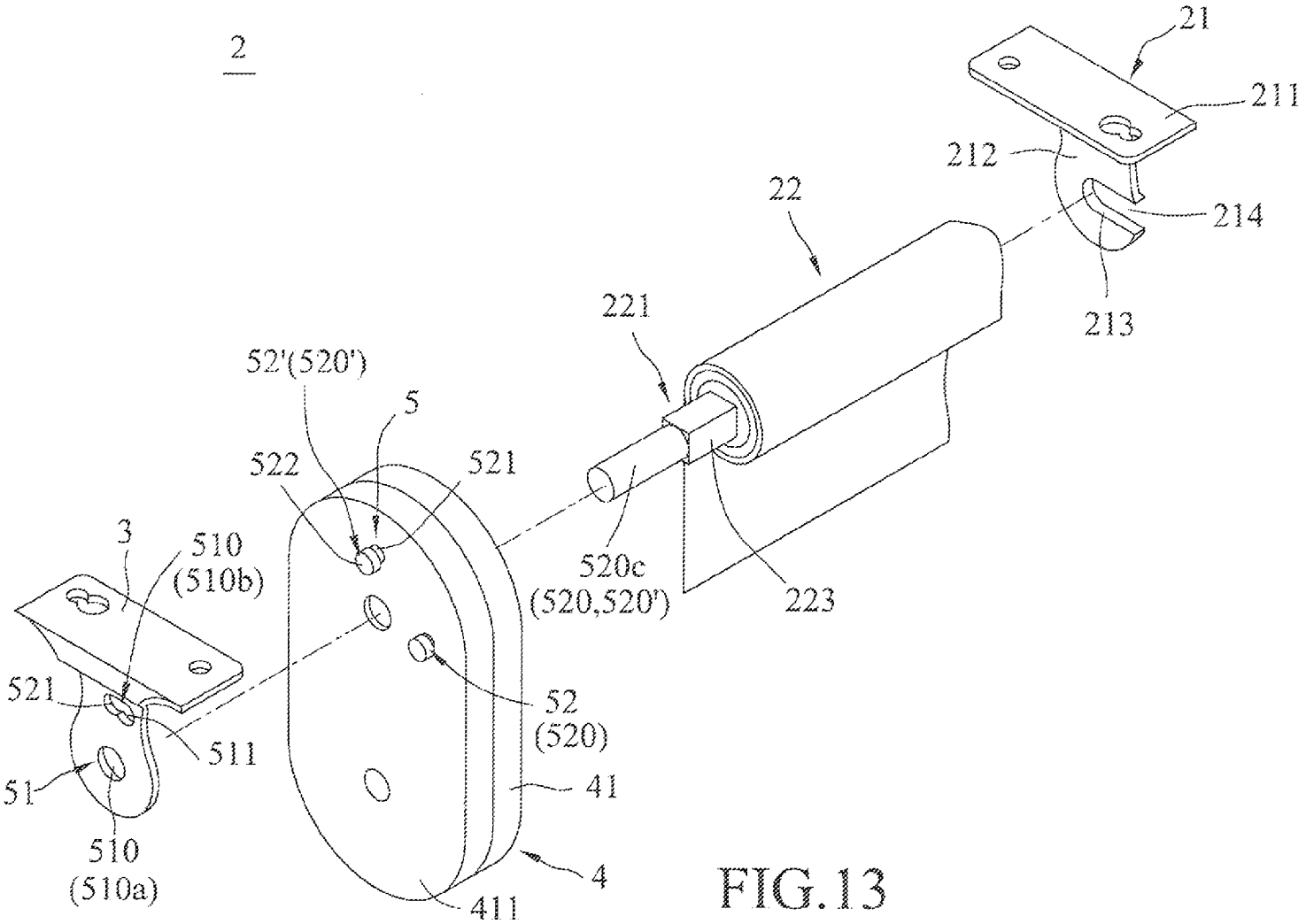
FIG. 13 is a fragmentary exploded perspective view of the fourth preferred embodiment of a cordless roller blind according to the present invention.
Figure 14:
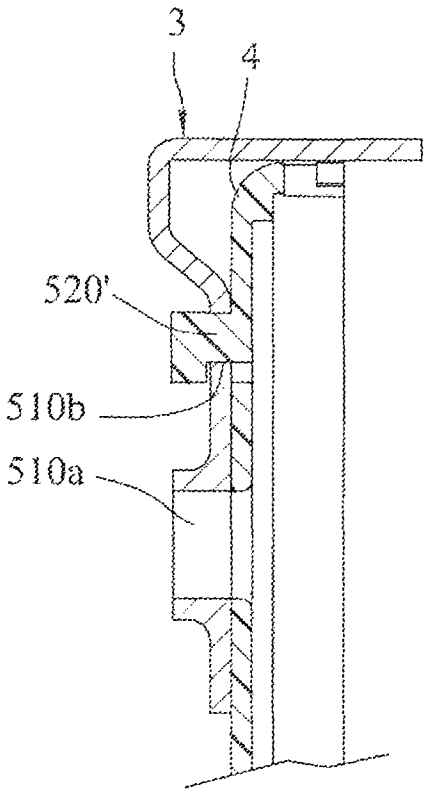
FIG. 14 is a fragmentary sectional view of the winding device of the fourth preferred embodiment.
Figure 16:
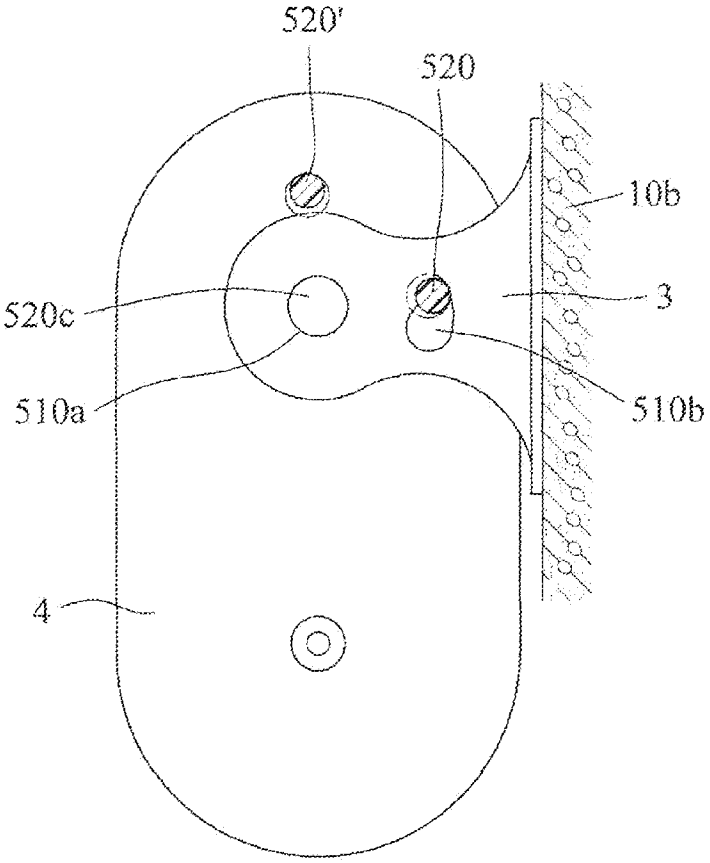
FIG. 16 is similar to FIG. 15, but illustrating when the fourth preferred embodiment is mounted on a vertical supporting structure.
Figure 15:
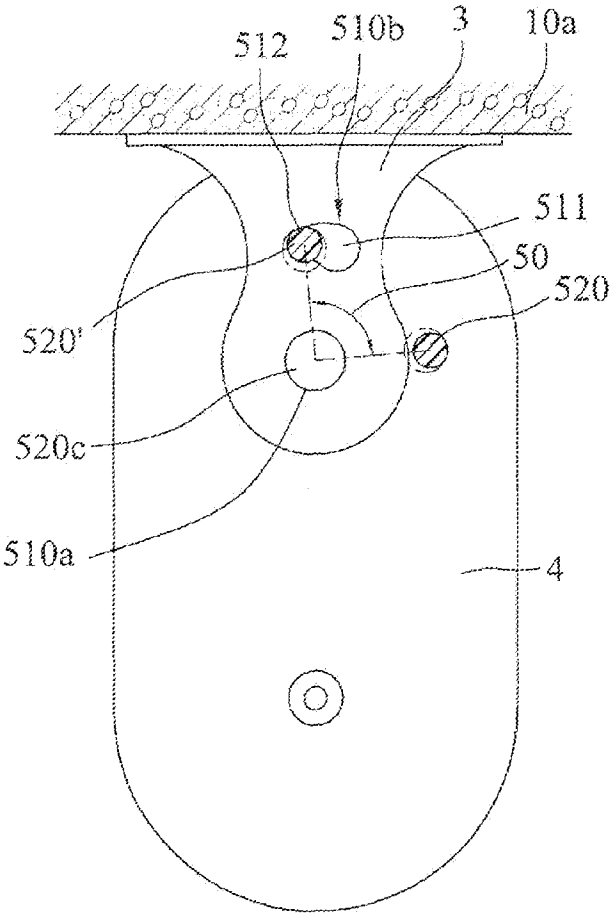
FIG. 15 is a schematic diagram for illustrating the mounting seat and the casing of the winding device when the fourth preferred embodiment is mounted on a horizontal supporting structure.

Referring to FIGS. 13 to 15, the fourth preferred embodiment of a cordless roller blind 2 according to the present invention is similar to the third preferred embodiment, but differs in that the first connecting set 51 includes two first connecting elements 510 in the form of through holes formed in the mounting seat 3; that of the two first connecting elements 510, one 510*a* is a circular through hole and the other 510*b* has a large dimension portion 511 and a small dimension portion 512 connected to the large dimension portion 511 and smaller in dimension than the large dimension portion 511; that there are two second connecting sets 52, 52', each including two second connecting elements 520, 520' in the form of protrusions with a common second connecting element 520*c* among the two second connecting sets 52, 52' (i.e., there are three second connecting elements 520, 520' in total), where the common second connecting element 520*c* is coaxially and integrally formed with the link head 223 of the pole 221 and extends through the casing 41 and protrudes from the first casing wall 411 and the other second connecting elements 520, 520' are formed protrudingly and integrally from the first casing wall 411, where the common second connecting element 520*c* is equidistant from the other second connecting elements 520, 520', and where a line connecting the second connecting elements 520 of one second connecting set 52 forms a right angle 50 with a line connecting the second connecting elements 520' of the other second connecting set 52'; and that the common second connecting element 520*c* has a uniform cross-section, whereas the other two second connecting elements 520, 520' has a head portion 522 and a neck portion 521 that is connected to the head portion 522 and that is smaller in dimension than the head portion 522. To mount the winding unit 4 to the mounting seat 3, the first connecting element 510*a* is engaged with the common second connecting element 520*c* and the first connecting element 510*b* is engaged with one of the other second connecting elements 520, 520'. Further, in this embodiment, the mounting wall segment 212 of the securing is formed with a groove 213 from one side thereof, i.e., the groove 213 has an opening at said one side of the mounting wall segment 212. The pole 221 of the blind unit 22 is slidably received in the groove 213 through the opening 214. FIG. 15 shows the fourth preferred embodiment when mounted to the horizontal supporting structure 10*a*, while FIG. 16 shows the fourth preferred embodiment when mounted to the vertical supporting structure 10*b*. In addition to the same advantage achieved by the previous embodiments, the fourth preferred embodiment further allows convenient installation due to the formation of the opening 214.

In summary, due to the structural design of the connecting mechanism 5 including at least two second connecting sets 52, 52' in cooperation with the first connecting set 51, the winding device 20 of the present invention allows the cordless roller blind 2 incorporating such to be able to have the long side of the winding unit 4 be perpendicular to the ground regardless of whether the cordless roller blind 2 is mounted on a horizontal supporting structure 10*a* or a vertical supporting structure 10*b*, such that the winding unit 4 is always disposed in an upright state to thereby reduce the sideways protruding length of the cordless roller blind 2 after installation on the supporting structure 10. Moreover, this advantage is more prominent when the winding device 20 is used on a larger-scale cordless roller blind 2 which requires a greater torsion, i.e., a bulkier winding unit 4.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A winding device for a cordless roller blind, and adapted to be mounted to a supporting structure opposite to a securing seat to cooperate with the securing seat for securing therebetween a blind unit, which includes a pole and a blind wound around the pole, said winding device comprising:

a mounting seat adapted to be mounted on the supporting structure;

a winding unit including a casing and a winding set that is mounted to said casing and that is adapted for rolling the pole to bring the blind to fold upwardly and unfold downwardly relative to the securing seat and said mounting seat; and a connecting mechanism for connecting removably said winding unit to said mounting seat in such a manner that said winding unit is upright when connected to said mounting seat, said connecting mechanism including a first connecting set that is disposed on one of said casing and said mounting seat and at least two second connecting sets that are disposed on the other of said casing and said mounting seat, said first connecting set being removably engageable with one of said second connecting sets so as to connect removably said winding unit to said mounting seat;

wherein said first connecting set includes two first connecting elements, each of said second connecting sets including a second connecting element, said second connecting sets sharing a common second connecting element, one of said first connecting elements being engageable with said common second connecting element and the other of said first connecting elements being engageable with the other of said second connecting element of one of said second connecting sets;

wherein said second connecting element of each of said second connecting sets is a male connecting element in a form of a protrusion that extends from the other one of said casing and said mounting seat, a line that connects said second connecting element of one of said second connecting sets being substantially perpendicular to a line that connects said second connecting element of the other of said second connecting sets;

wherein said first connecting elements are female connecting elements in a form of through holes that are formed in said one of said casing and said mounting seat, one of said first connecting elements being a circular through hole and the other of said first connecting elements being a through hole that has a large dimension portion and a small dimension portion connected to said large dimension portion and smaller in dimension than said large dimension portion;

wherein said common second connecting element has a uniform circular cross-section, each of said second connecting elements other than said common second connecting element having a head portion and a neck portion that is connected to said head portion and that is smaller in dimension than said head portion;

wherein said head portion of said other of said second connecting element is extendible into said large dimension portion and is restricted from moving out of said other of said first connecting elements by said head portion when said other of said second connecting element is moved from having said neck portion extending through said large dimension portion to having said neck portion extending through said small dimension portion.

2. The winding device as claimed in claim 1, wherein said casing of said winding unit has a first casing wall disposed proximate to said mounting seat, said first connecting set being disposed on said mounting seat, said second connecting sets being disposed on said first casing wall.

3. A cordless roller blind adapted to be mounted to a supporting structure, comprising:

a blind unit including a pole and a blind wound around said pole;

a securing seat adapted to be mounted on the supporting structure; and a winding device comprising;

a mounting seat adapted to be mounted on the supporting structure; a winding unit including a casing and a winding set that is mounted to said casing and that is adapted for rolling the pole to bring the blind to fold upwardly and unfold downwardly relative to the securing seat and said mounting seat; and a connecting mechanism for connecting removably said winding unit to said mounting seat in such a manner that said winding unit is upright when connected to said mounting seat, said connecting mechanism including a first connecting set that is disposed on one of said casing and said mounting seat and at least two second connecting sets that are disposed on the other of said casing and said mounting seat, said first connecting set being removably engageable with one of said second connecting sets so as to connect removably said winding unit to said mounting seat;

wherein said first connecting set includes two first connecting elements, each of said second connecting sets including a second connecting element, said first connecting elements being respectively engageable with said second connecting elements of one of said second connecting sets;

wherein said winding device includes two of said second connecting sets, said second connecting element being a male connecting element in a form of protrusions that extend from the other one of said casing and said mounting seat, a line that connects said second connecting element of one of said second connecting sets being substantially perpendicular to a line that connects said second connecting element of the other of said second connecting sets;

wherein said first connecting elements are female connecting elements in a form of through holes that are formed in said one of said casing and said mounting seat, one of said first connecting elements being a circular through hole and the other of said first connecting elements being a through hole that has a large dimension portion and a small dimension portion connected to said large dimension portion and smaller in dimension than said large dimension portion;

wherein said second connecting sets share a common second connecting element, which has a uniform circular cross-section, each of said second connecting elements other than said common second connecting element having a head portion and a neck portion that is connected to said head portion and that is smaller in dimension than said head portion;

wherein one of said first connecting elements is engageable with said common second connecting element and the other of said first connecting elements is engageable with the other of said second connecting element of one of said second connecting sets, where said head portion of said other of said second connecting element is extendible into said large dimension portion and is restricted from moving out of said other of said first connecting elements by said head portion when said other of said second connecting element is moved from having said neck portion extending through said large dimension portion to having said neck portion extending through said small dimension portion.

4. The cordless roller blind as claimed in claim 3, wherein said casing of said winding unit has a first casing wall disposed proximate to said mounting seat, said first connecting set being disposed on said mounting seat, said second connecting sets being disposed on said first casing wall.

5. The cordless roller blind as claimed in claim 4, wherein said common second connecting element is integrally and coaxially formed with said pole of said blind unit, and extends through said casing to be engaged with said one of said first connecting elements, each of said second connecting elements other than said common second connecting element is integrally formed with and protrudes from said first casing wall.

6. The cordless roller blind as claimed in claim 5, wherein said securing seat includes a securing wall segment adapted to be secured to the supporting structure and a mounting wall segment extending transversely from said securing wall segment, adapted to protrude from the supporting structure, and formed with a groove that has an opening at one side of said mounting wall segment, said pole of said blind unit being slidably received in said groove through said opening.

* * * * *